US009055370B2

(12) United States Patent
Link et al.

(10) Patent No.: US 9,055,370 B2
(45) Date of Patent: Jun. 9, 2015

(54) VIBRATION-REDUCING PASSIVE RADIATORS

(75) Inventors: Christopher J. Link, Arlington, MA (US); Hal Greenberger, Natick, MA (US)

(73) Assignee: Bose Corporation, Framingham, MA (US)

( * ) Notice: Subject to any disclaimer, the term of this patent is extended or adjusted under 35 U.S.C. 154(b) by 356 days.

(21) Appl. No.: 13/600,316

(22) Filed: Aug. 31, 2012

(65) Prior Publication Data

US 2014/0064539 A1 Mar. 6, 2014

(51) Int. Cl.
*H04R 1/28* (2006.01)

(52) U.S. Cl.
CPC ..... *H04R 1/2834* (2013.01); *H04R 1/2873* (2013.01)

(58) Field of Classification Search
CPC .... H04R 1/2826; H04R 1/2834; H04R 1/283; H04R 1/2807; H04R 1/2857; H04R 1/124; H04R 1/345; H04R 7/20; H04R 7/16; H04R 7/24; H04R 7/26; H04R 5/02; H04R 2205/022; H04R 1/28; H04R 1/26; H04R 1/22; H04R 1/24
USPC ..... 381/186, 162, 345–354, 386, 160, 182
See application file for complete search history.

(56) References Cited

U.S. PATENT DOCUMENTS

| | | | |
|---|---|---|---|
| 1,536,116 | A | 5/1925 | Martin |
| 1,579,864 | A | 4/1926 | Hobart |
| 1,583,490 | A | 5/1926 | Peterson |
| 1,614,327 | A | 1/1927 | Thomas |
| 1,633,170 | A | 6/1927 | Fischer |
| 1,633,366 | A | 6/1927 | Fischer |
| 1,683,946 | A | 9/1928 | Baldwin |
| 1,690,147 | A | 11/1928 | Waddell |
| 1,693,223 | A | 11/1928 | Danziger |
| 1,713,210 | A | 5/1929 | Barton |
| 1,718,357 | A | 6/1929 | Miller |
| 1,726,533 | A | 9/1929 | Baldwin |
| 1,732,644 | A | 10/1929 | Farrand |

(Continued)

FOREIGN PATENT DOCUMENTS

| | | | |
|---|---|---|---|
| BE | 345834 | A | 11/1927 |
| DE | 646416 | | 6/1937 |

(Continued)

OTHER PUBLICATIONS

C-Flex The Bearing Solution Product Information; Frictionless, Low Hysteresis Bearing for Angular Applications; Bearing Co., Inc.

(Continued)

*Primary Examiner* — Davetta W Goins
*Assistant Examiner* — Jasmine Pritchard
(74) *Attorney, Agent, or Firm* — Brian M. Dingman; Dingman, McInnes & McLane, LLP

(57) ABSTRACT

An audio system includes a passive radiator that is attached to one end of a lever arm. The other end of the lever arm is attached to a mass that serves to move out of phase of the passive radiator to cancel mechanical vibrations of the passive radiator, but without significantly affecting audio output. The lever arm is attached to a mechanical ground, which may be the enclosure on which the passive radiator is mounted. A system may use multiple lever arms to reduce rocking of the passive radiator.

28 Claims, 8 Drawing Sheets

(56) References Cited

U.S. PATENT DOCUMENTS

| | | | | |
|---|---|---|---|---|
| 1,784,517 | A | 12/1930 | Farrand | |
| 1,823,512 | A | 9/1931 | Ringel | |
| 1,844,605 | A | 2/1932 | Seabert | |
| 2,078,469 | A | 4/1937 | Thomas | |
| 3,062,926 | A | 11/1962 | Ronci | |
| 3,454,912 | A | 7/1969 | Morrison | |
| 3,460,080 | A | 8/1969 | Carbonaro | |
| 3,701,865 | A | 10/1972 | Carlson et al. | |
| 3,777,078 | A | 12/1973 | Boutros-Attia et al. | |
| 3,836,733 | A | 9/1974 | Cragg | |
| 3,878,725 | A | 4/1975 | Gaertner | |
| 3,937,904 | A | 2/1976 | Parker | |
| 4,000,381 | A | 12/1976 | Plice et al. | |
| 4,126,769 | A | 11/1978 | Broersma | |
| 4,379,952 | A | 4/1983 | Kaizer et al. | |
| 4,387,275 | A | 6/1983 | Shimada et al. | |
| 4,547,631 | A | 10/1985 | Nieuwendijk et al. | |
| 4,564,727 | A | 1/1986 | Danley et al. | |
| 4,825,713 | A | 5/1989 | Wilkey | |
| 5,216,723 | A | 6/1993 | Froeschle et al. | |
| 5,588,065 | A * | 12/1996 | Tanaka et al. | 381/96 |
| 5,664,020 | A * | 9/1997 | Goldfarb et al. | 381/89 |
| 5,701,359 | A * | 12/1997 | Guenther et al. | 381/431 |
| 5,802,189 | A | 9/1998 | Blodget | |
| 5,809,157 | A | 9/1998 | Grumazescu | |
| 5,859,731 | A | 1/1999 | Vezain et al. | |
| 5,883,339 | A * | 3/1999 | Greenberger | 181/131 |
| 6,169,811 | B1 * | 1/2001 | Croft, III | 381/186 |
| 6,176,345 | B1 * | 1/2001 | Perkins et al. | 181/173 |
| 6,396,936 | B1 | 5/2002 | Nevill | |
| 6,778,677 | B2 | 8/2004 | Coffin | |
| 6,851,513 | B2 | 2/2005 | Stead et al. | |
| 6,889,796 | B2 | 5/2005 | Pocock et al. | |
| 7,174,990 | B2 | 2/2007 | Stead et al. | |
| 7,190,803 | B2 | 3/2007 | van Halteren | |
| 7,366,317 | B2 | 4/2008 | Miller et al. | |
| 7,386,137 | B2 | 6/2008 | Combest | |
| 7,412,763 | B2 | 8/2008 | Jiles et al. | |
| 7,480,390 | B2 | 1/2009 | Tabata et al. | |
| 7,508,953 | B2 | 3/2009 | Hlibowicki | |
| 7,860,264 | B2 | 12/2010 | Jiles et al. | |
| 8,085,955 | B2 | 12/2011 | Henry | |
| 8,139,813 | B2 | 3/2012 | Kobayashi et al. | |
| 8,290,198 | B2 * | 10/2012 | Ogasawara et al. | 381/396 |
| 2002/0146145 | A1 * | 10/2002 | James et al. | 381/426 |
| 2005/0141744 | A1 | 6/2005 | Hlibowicki | |
| 2005/0157900 | A1 | 7/2005 | Litovsky et al. | |
| 2005/0168111 | A1 | 8/2005 | Bank et al. | |
| 2007/0081687 | A1 * | 4/2007 | Hayashi | 381/345 |
| 2007/0092091 | A1 * | 4/2007 | Noro et al. | 381/111 |
| 2007/0201712 | A1 * | 8/2007 | Saiki | 381/186 |
| 2007/0272475 | A1 | 11/2007 | Stead et al. | |
| 2007/0291965 | A1 * | 12/2007 | Noro et al. | 381/182 |
| 2008/0247595 | A1 | 10/2008 | Henry | |
| 2009/0097667 | A1 * | 4/2009 | Botti et al. | 381/59 |
| 2009/0245561 | A1 * | 10/2009 | Litovsky et al. | 381/345 |
| 2011/0069859 | A1 * | 3/2011 | Kobayashi et al. | 381/400 |
| 2011/0176703 | A1 | 7/2011 | Horigome et al. | |
| 2011/0243365 | A1 | 10/2011 | Carlmark et al. | |
| 2011/0243366 | A1 | 10/2011 | Carlmark et al. | |
| 2012/0106772 | A1 | 5/2012 | Horigome et al. | |
| 2013/0322656 | A1 * | 12/2013 | Adams | 381/120 |

FOREIGN PATENT DOCUMENTS

| | | | |
|---|---|---|---|
| EP | 0508570 | | 10/1992 |
| EP | 2146521 | A1 | 1/2010 |
| FR | 572766 | | 6/1924 |
| GB | 212857 | A | 3/1924 |
| GB | 220990 | A | 8/1924 |
| GB | 0248176 | A | 3/1926 |
| GB | 0310759 | A | 4/1929 |
| GB | 0361464 | A | 11/1931 |
| GB | 396990 | | 8/1933 |
| GB | 1294960 | | 11/1972 |
| GB | 1426391 | A | 2/1976 |
| GB | 2071961 | A | 9/1981 |
| JP | 58107799 | | 6/1983 |
| JP | 08079885 | A | 3/1996 |
| WO | 0054550 | A2 | 9/2000 |
| WO | 2010106690 | | 9/2010 |

OTHER PUBLICATIONS

C-Flex The Bearing Solution Technical Data; Frictionless, Low Hysteresis Bearing for Angular Applications; Bearing Co., Inc.

International Search Report and Written Opinion Dated Jun. 15, 2011 PCT/US2011/028965.

International Search Report and Written Opinion Dated Jun. 15, 2011for PCT/US2011/028960.

McLachlan, N. W.; Loud Speakers, Theory Performance, Testing and Design, Dover Publications, Inc., NY, NY 1960 pp. 225-226.

Olsen, Harry F.; Microphones, Acoustical Engineering, Professional Audio Journals, Inc., Philadelphia, PA 1991 pp. 270-271.

* cited by examiner

VIBRATION-REDUCING PASSIVE RADIATORS

BACKGROUND

This disclosure generally relates to structures for passively radiating sound waves, typically sound wave for reproducing low frequency audio (or bass). For background, reference is made to the pending application Ser. No. 12/751,352 filed on Mar. 31, 2010, for MOVING MAGNET LEVERED LOUDSPEAKER, the entire disclosure of which is hereby incorporated by reference.

SUMMARY

In one aspect, an audio system uses at least one lever arm assemblies to mass balance a passive radiator. Multiple lever arm assemblies may also be used to mass balance a passive radiator. In addition, multiple lever arm assemblies may be arranged around the passive radiator such that they also reduce rocking modes of the passive radiator, and may be configured to essentially torque balance the passive radiator. Each lever arm assembly includes a fulcrum fixed to a mechanical ground, a lever arm attached the passive radiator on one side of the fulcrum and a counterbalance mass attached on the other side of the fulcrum.

In another aspect, an audio system includes an enclosure enclosing a volume of air, a passive radiator mounted to the enclosure and in fluid communication with the volume of air, a fulcrum fixed to a mechanical ground, and a lever arm attached to the passive radiator on a first side of the fulcrum and a mass coupled to it on a second side of the fulcrum. With this arrangement, the lever arm and its mass move with the passive radiator such that it reduces a level of vibration transmitted to the mechanical ground caused by movement of the passive radiator, when compared with the level of vibration transmitted to the mechanical ground by movement of the passive radiator without the operation of the lever arm and its mass.

In some implementations, the mechanical ground may be the enclosure of the audio system. Also, multiple lever arms may be used to reduce the level of vibration transmitted to the mechanical ground by the passive radiator. In addition, multiple lever arms may be arranged to provide a greater resistance to rocking by the passive radiator when compared with the passive radiator without operation of the lever arms and their masses. The fulcrum of the lever arms may be attached to the same enclosure wall as the passive radiator, or a different call (such as wall adjacent to or opposite of the wall on which the passive radiator is mounted). The system may include one or more transducers that are in fluid communication with the volume of air, and, if two (or more) transducers are used, they may be mounted such that their acoustic energy adds while their mechanical vibrations into the enclosure subtract. The lever arm may be attached to the passive radiator with a coupling that allows for the simultaneous linear movement of the passive radiator and actuate movement of the passive radiator. This coupling may be a compliant coupling.

In another aspect, an audio system includes an enclosure enclosing a volume of air, a passive radiator, and a plurality of lever arms coupled to the passive radiator at a first end of each lever arm. Each lever arm is further pivotally attached to a fulcrum and each fulcrum is attached to a mechanical ground. Each lever arm also includes a mass on the side of the fulcrum opposed the side on which the lever arm is attached to the passive radiator such that the lever arms move the masses out of phase with movement of the passive radiator.

In some implementations, the plurality of lever arms may be arranged to torque balance the passive radiator. The plurality of lever arms may be attached symmetrically around a surface of the passive radiator. The plurality of lever arms may be arranged to provide a greater resistance to rocking by the passive radiator when compared with the passive radiator without operation of the lever arms and their masses. The fulcrum of the lever arms may be attached to the same enclosure wall as the passive radiator, or a different call (such as wall adjacent to or opposite of the wall on which the passive radiator is mounted). The enclosure of the audio system may be the mechanical ground of the lever arms.

In another aspect, a passive radiator assembly (suitable for mounting in an acoustic enclosure) includes a diaphragm, a flexible surround coupled to the diaphragm that permits movement of the diaphragm in response to pressure fluctuations in the enclosure, and a lever arm assembly. The lever arm assembly includes a fulcrum configured to be fixed to a mechanical ground, a lever arm attached to the diaphragm on a first side of the fulcrum and a mass coupled to the lever arm on the second side of the fulcrum.

In some implementations, the passive radiator assembly may include multiple lever arms, each have a fulcrum configured to attach to a mechanical ground on one side of the lever arm and a mass coupled to the opposite side of the lever arms. The multiple lever arms may be arranged to reduce rocking by the passive radiator (when compared with a passive radiator with no lever arms) and may be arranged to completely torque balance the passive radiator.

DETAILED DESCRIPTION

Figure 1:
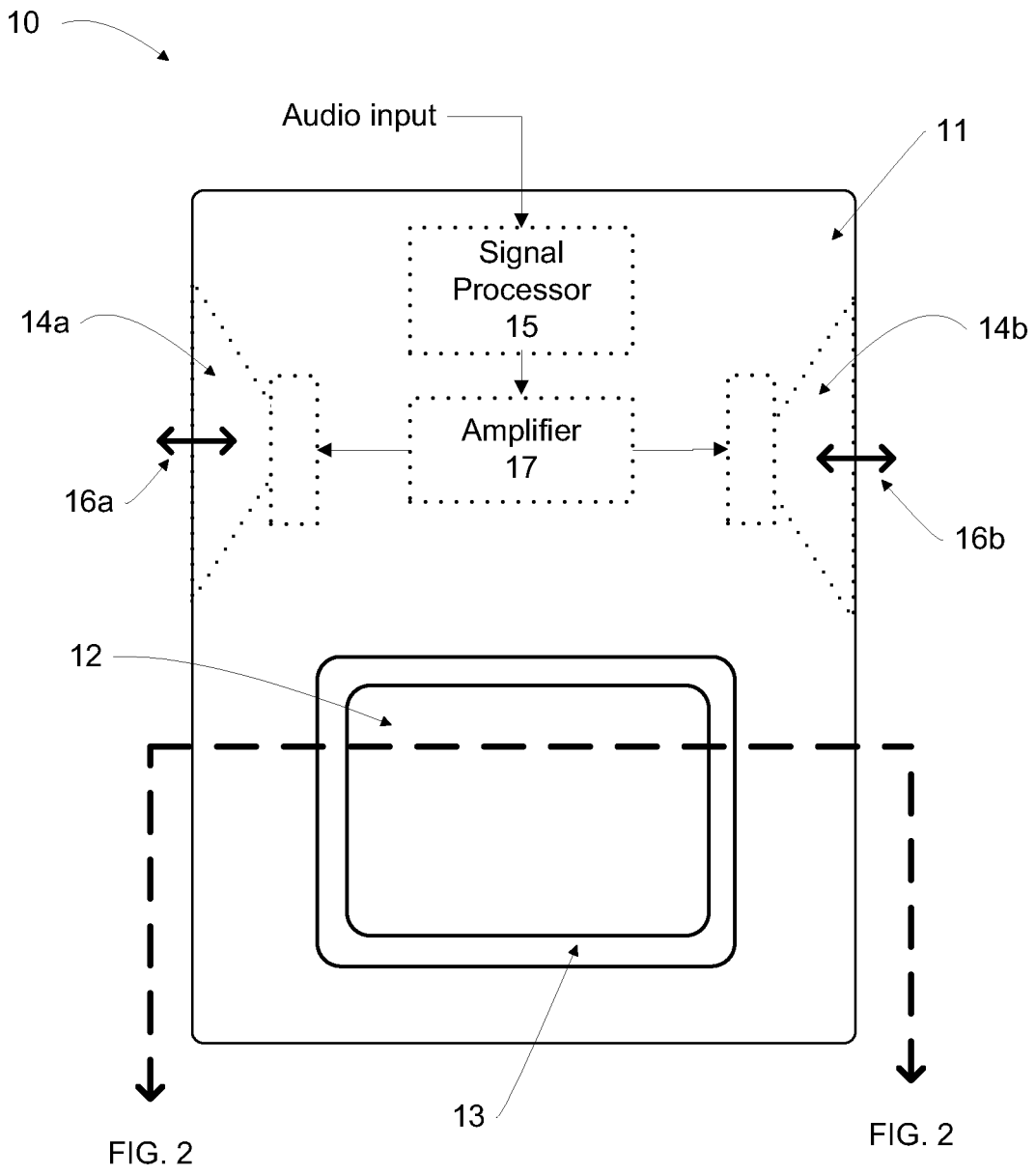
FIG. 1 is a front view of an enclosure with opposed drivers and a passive radiator.
Figure 2:
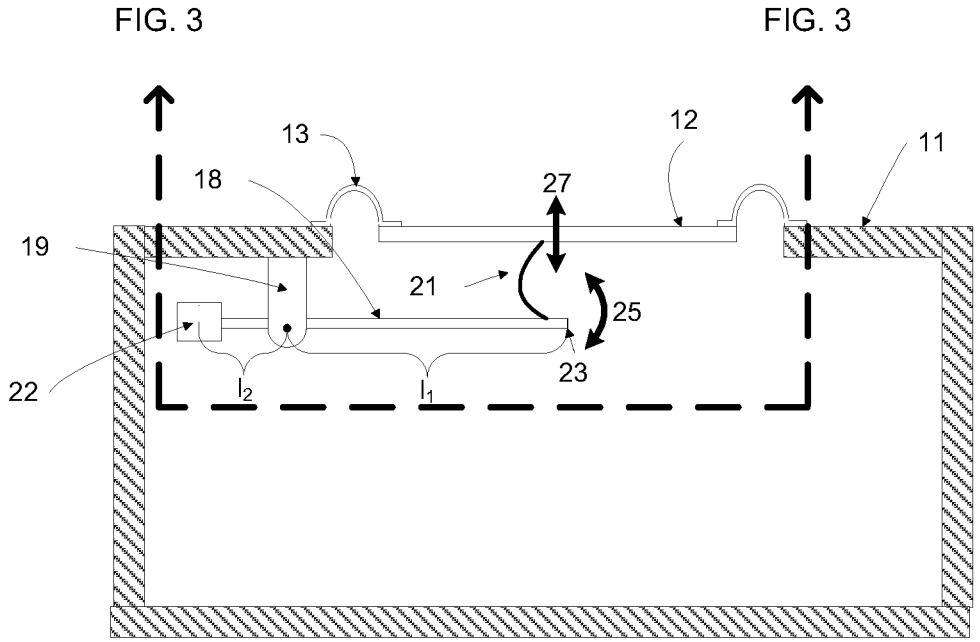
FIGS. 2-3 are cut-away views of the enclosure of FIG. 1.
Figure 3:
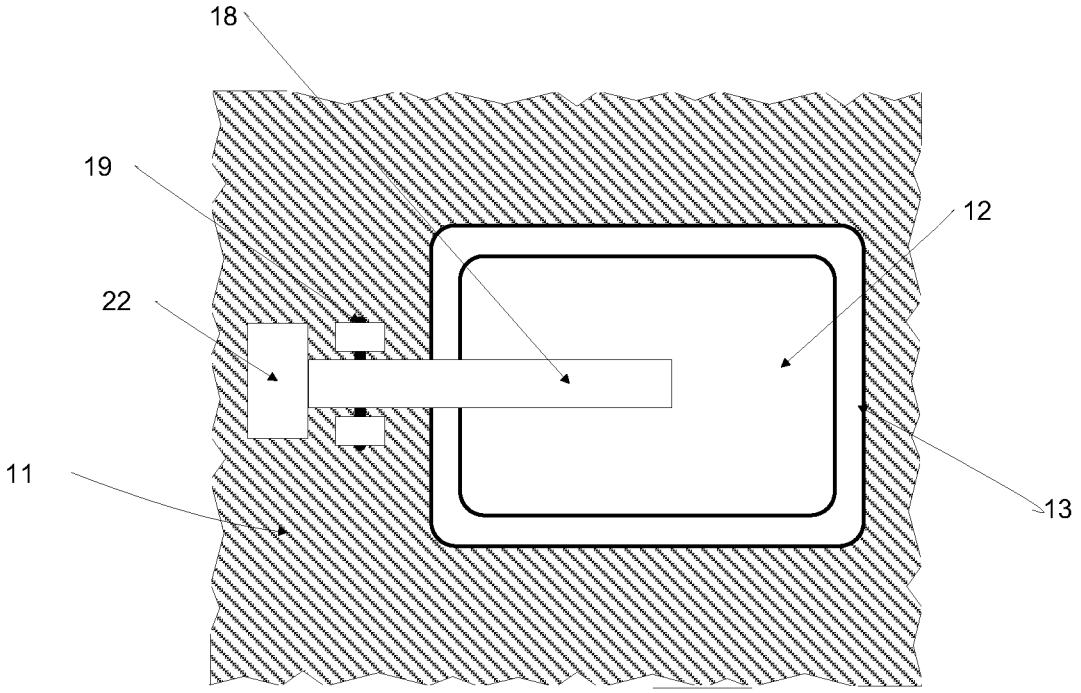

As shown in FIG. 1-3, a speaker system 10 includes passive radiator 12 which in this example is a rectangular-shape but may be other shapes such as round, elliptical, etc., and a pair of acoustic transducers 14*a*, 14*b* mounted on an enclosure 11 which encloses a volume of air. The pair of acoustic transducers 14*a*, 14*b* and the passive radiator 12 are in fluidic communication with the volume of air. The passive radiator 12 includes a suspension element 13 (e.g., a surround) that permits the passive radiator to move back and forth (i.e., into and out of the page as shown in FIG. 1). System 10 also includes a processor 15 that performs various signal processes on a received audio signal (e.g., audio decompression, equalization, digital-to-analog conversion, etc.) and an amplifier 17 that amplifies the processed audio signal and supplies it to the transducers 14*a*, 14*b*. Processor 15 and amplifier 17 may be located within enclosure 11, or they may be located external to enclosure 11 in electrical communication with transducers 14*a* and 14*b*.

Note that in this example, transducer 14*a* and transducer 14*b* receive the same signal. Thus, the two transducers will move symmetrically (as shown by arrows 16*a*, 16*b*). As the two transducers move together, their acoustic energy adds. However, since the transducers are mounted on opposite walls of the enclosure, their mechanical vibrations cancel—for example, as transducer 14*a* moves to the left as shown in FIG. 1 (i.e., away from the center of the enclosure), transducer 14*b* moves to the right (i.e., also away from the center of the enclosure). Reducing the mechanical vibration of the transducers (and other moving elements of the system 10) helps to prevent the system 10 from vibrating on the surface on which system 10 is placed. Reducing mechanical vibration also helps to prevent components (e.g., a speaker grill) in system 10 from squeaking, rattling, or making other unwanted noise. Should System 10 be attached to a larger system (such as a bass box attached to an automotive interior assembly) the reduced mechanical vibration would help to reduce unwanted buzz, squeak, and rattle noises.

System 10 also includes a passive radiator 12 that is acoustically coupled with the transducers 14*a*, 14*b* through the sealed volume of air within the enclosure. The design of passive radiator based loudspeaker systems is known, and will not be described in detail here. In brief, the passive radiator in conjunction with the volume of air contained in enclosure 11 forms a resonant system. A loudspeaker designer will choose a tuning frequency for this resonant system according to a design goal for the loudspeaker system. Once the designer has chosen a desired tuning frequency (the details of determining such a tuning frequency are known and will not be described), the area of the passive radiator diaphragm, the moving mass of the diaphragm assembly, the volume of the enclosure, and the compliance of the passive radiator suspension are determined. The tuning frequency is determined by the moving mass of the diaphragm (comprising the diaphragm physical mass and any associated acoustic mass of the air load on the passive radiator diaphragm), the effective mechanical compliance of the air in enclosure 11 (determined by the volume of enclosure 11 and the passive radiator diaphragm area), and the passive radiator suspension compliance.

A lever arm 18 (shown in FIGS. 2-3) is mounted to the passive radiator 12 within the enclosure and serves to cancel inertial forces caused by movement of the passive radiator without significantly affecting the acoustic output of the passive radiator. More specifically, lever arm 18 is pivotally supported to the inside of the enclosure 11 at a fulcrum 19. The fulcrum 19 is mounted on a mechanical ground, which in this example is the inside surface of the enclosure 11 of system 10. The mechanical ground is intended—in this example—to remain relatively vibration-free as the passive radiator 12 (and other moving components such as the lever arm 18 and transducers 14*a* and 14*b* move). Note that by selecting the enclosure 11 as the mechanical ground, relatively little mechanical vibration is output by the system 10 to a table top or other surface on which the system sits.

One end of the lever arm 18 (i.e., the end near the tip 23 of the lever arm 18) is attached to the center of the inner surface of the passive radiator 12 with a coupling 21. At the opposite end of the lever arm a counter-balance mass 22 is mounted, which is selected such that it cancels the inertia of the moving passive radiator. Assuming the mass of the lever arm 18, coupling 21, and suspension element 13 are small in comparison to the mass of the passive radiator 12 and counterbalance mass 22, the total effective moving mass of the system $M_T$ (i.e., the passive radiator 12, lever arm 18, and counterbalance mass 22) of a single-lever system can be expressed as follows:

$$M_T = M_{radiator} + (l_2/l_1)^2 * M_{counterbalance} \quad \text{(equation 1)}$$

Where:

$M_{radiator}$ is the mass of the passive radiator diaphragm 12, $M_{counterbalance}$ is the mass of the counter-balance mass 22, $l_1$ is the length of the lever arm between the tip 23 attached to the passive radiator 12 and fulcrum 19, and $l_2$ is the length of the lever arm between the fulcrum and the center of gravity of the counter-balance mass (see FIG. 2).

To inertial balance the system, the mass of the passive radiator diaphragm ($M_{radiator}$) can be set as follows:

$$M_{radiator} = (l_2/l_1)^2 * M_{counterbalance} \quad \text{(equation 2)}$$

Substituting equation 2 into equation 1, the following result is obtained:

$$M_T = M_{radiator} + M_{radiator} = 2 * M_{radiator}, \text{or}$$

$$M_{radiator} = \tfrac{1}{2} * M_T \quad \text{(equation 3)}$$

Thus, the moving mass of the passive radiator 12 can be set to ½ of the total desired effective moving mass ($M_T$) of the passive radiator assembly. The total effective moving mass ($M_T$) is the moving mass which along with the passive radiator suspension stiffness and stiffness due to the air in the box determines the resonance frequency of the passive radiator system.

The above analysis provides a useful simplification for understanding the behavior and relationships among system elements. If a designer wished to be more precise, the designer would also consider the effects of the lever arm masses, friction in the fulcrum pivot, stiffness of the coupling, stiffness of the lever arm, etc. in the system design. To consider these elements in the design, a finite element model of the complete mechanical system could be developed using commercially available software tools such as Abaqus Unified FEA, available from Dassault Systèmes of Vélizy-Villacoublay, France.

Additionally, one would also consider the fact that motion of the diaphragm is generally linear along a single axis, while motion of the compensating mass is arcuate. The component of the momentum of the compensating mass aligned with the axis of motion of the passive radiator diaphragm will be proportional to the cosine of the angle of displacement of its lever arm. For small angular displacements, the cosine is approximately equal to 1, and there is little error introduced by assuming the compensating mass moves linearly. As the angle of displacement of the lever arm increases, the cosine of the angle of decreases, the component of momentum of the compensating mass aligned with the axis of motion of the passive radiator diaphragm will decrease, and the relative momentums of the compensating mass and the moving mass of the passive radiator will no longer exactly offset each other. As such, it may be desirable for the system designer to choose compensating mass and lever arm segment lengths to obtain smaller angular displacements for a given passive radiator displacement. It may also be desirable, for system designs with larger angular displacement of the lever arms, for the compensating mass to be chosen such that it is slightly larger than ½ the desired tuning mass, and the moving mass of the passive radiator is chosen to be slightly less than ½ the tuning mass. This would sacrifice momentum cancellation for smaller angular displacements, but would improve it for larger angular displacements.

Using the above simplified equations, a system can be designed by first determining the total desired effective moving mass ($M_T$) of the passive radiator assembly, as discussed previously. Once $M_T$ is determined, the mass of the passive radiator diaphragm can be set to be ½*$M_T$ (equation 2), and then the counter-balance mass and lever arm lengths $l_1$ and $l_2$ can be selected using equation 2. Note that the magnitude of the counter-balance mass is effected by selection of lever arm lengths. Choosing a high-value lever arm ratio (i.e., $l_2/l_1$) will require a smaller counter-balance mass, but the counter-balance mass will travel a greater distance to counter-act vibration of the passive radiator. Conversely, choosing a low lever arm ration will require a larger counter-balance mass, but the counter-balance mass will travel a smaller distance to counter-act vibration of the passive radiator. It should be noted that the counterbalance mass and lever arm ratio need not be selected to exactly counterbalance the mass of the passive radiator 12. For example, the product lever arm ratio and passive radiator mass (i.e., $l_1/l_2$* $M_{radiator}$,) may be selected to be slightly smaller (or even larger) than the mass of the passive radiator to cancel some (but not all) vibration produced by movement of the passive radiator 12.

Since the tip 23 of the lever arm 18 will move in an arc (illustrated by arrow 25 in FIG. 2) while the passive radiator moves in a linear motion (illustrated by arrow 27 in FIG. 2), the coupling 21 is preferably designed to accommodate this difference in the relative motion between the tip 23 of the lever arm and the passive radiator. In some implementations, a compliant coupling (e.g., a rubber coupling) can accommodate the difference in relative motion between the passive radiator and tip of the lever arm. If a compliant link is used, it is desirable to make it sufficiently stiff such that the resonance of the link's compliance when attached to the particular diaphragm is outside the operating frequency range of the passive radiator. In addition, the compliance should be such that the motion of the end of the lever arm attached to the flexure is in-phase (or approximately in-phase) with the motion of the diaphragm over the operating range of the passive radiator. Otherwise, the motion of the counter-balance mass will not properly cancel the inertia of the diaphragm moving mass.

In operation, as the passive radiator moves in one direction (e.g., outward from the center of the enclosure as shown in FIG. 1), the lever arm 18 pivots about the fulcrum 19 and moves the mass 22 in the opposite direction (e.g., inward toward the center of the enclosure as shown in FIG. 1). This serves to cancel the inertial forces caused by movement of the passive radiator and reduce vibration experienced by the system 10. Assuming the mass of the lever arm 19 and coupling 21 are small relative to the mass of the passive radiator 12 and there is a low friction pivot at the fulcrum 19, the acoustic output of the passive radiator is not significantly impeded by the lever arm 18 and counter-balance mass 22.

Figure 4:
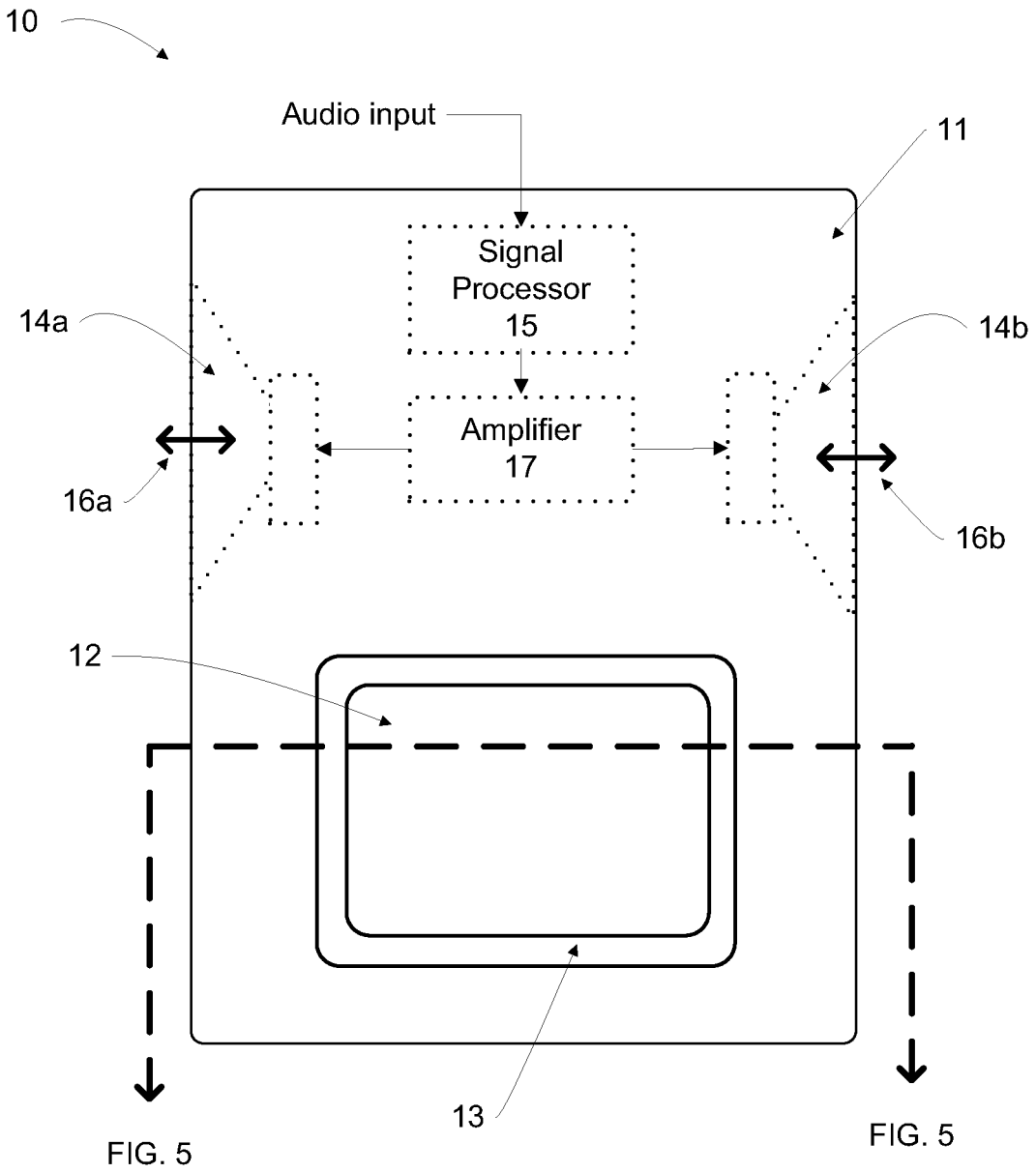
FIG. 4 is a front view of an enclosure with opposed drivers and a passive radiator.
Figure 5:
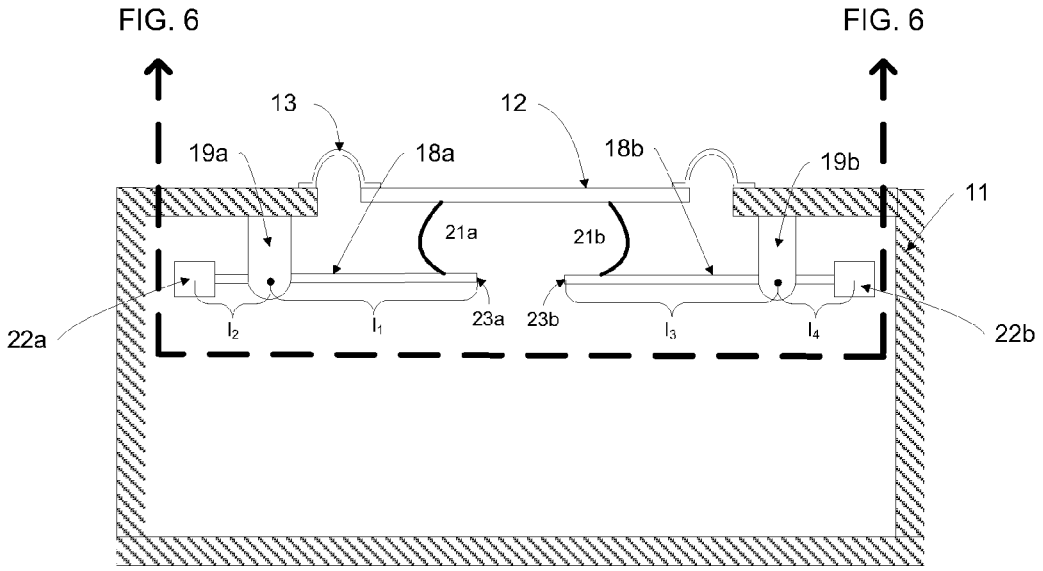
FIGS. 5-6 are cut-away views of the enclosure of FIG. 4.
Figure 6:
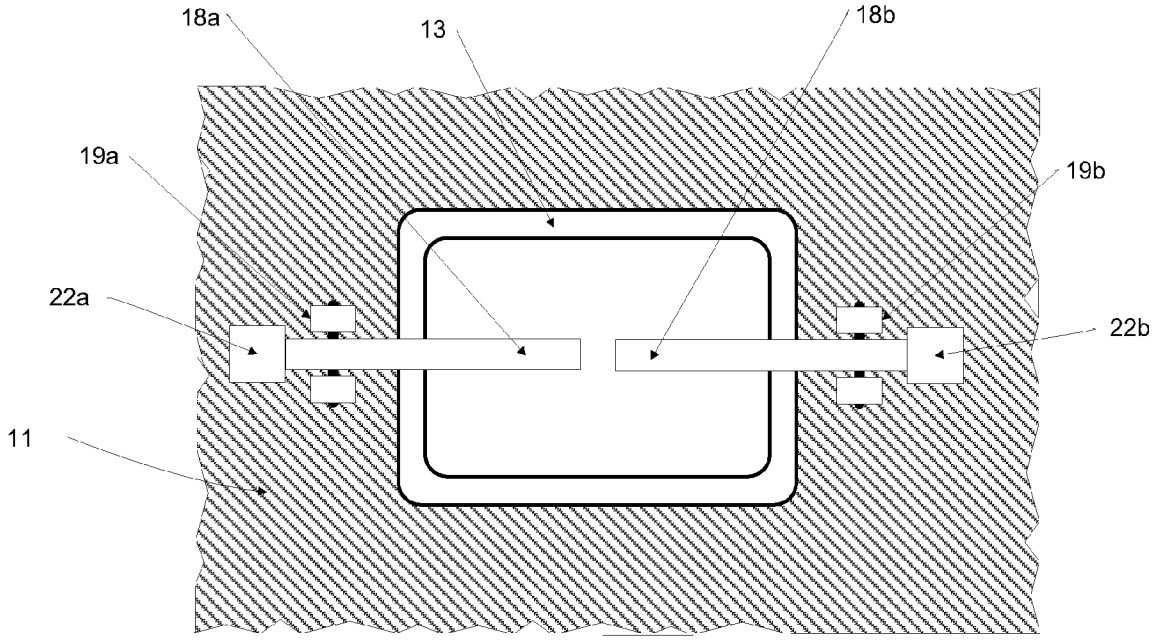

As shown in FIGS. 4-6, multiple lever arms are used to mass balance (like the system shown in FIGS. 1-3) as well as torque balance the passive radiator 12. In this example, two identical lever arms 18*a*, 18*b* are mechanically coupled to the passive radiator 12 via a coupling 21*a*, 21*b*. The couplings 21*a*, 21*b* should be designed to accommodate the relative difference in motion between the tip of the lever arms (which moves in an arc) and the passive radiator (which moves in a line).

Attached to each lever arm is identical compensating mass 22*a*, 22*b*. The mass elements 22*a*, 22*b* are selected to balance the mass of the passive radiator 12. Assuming the mass of the lever arms (18*a*, 18*b*), coupling (21*a*, 21*b*), and suspension element 13 are small in comparison to the mass of the passive radiator 12, the total effective moving mass of the system $M_T$ (i.e., the passive radiator 12, lever arms 18*a* and 18*b*, and counterbalance masses 22*a* and 22*b*) of a double-lever system can be expressed as follows:

$$M_T=M_{radiator}+(l_2/l_1)^2*M_{counterbalance_1}+(l_4/l_3)^2*M_{counterbalance_2} \quad \text{(equation 4)}$$

Where:

$M_{radiator}$ is the mass of the passive radiator diaphragm 12, $M_{counterbalance_1}$ is the mass of the counter-balance mass 22*a* of the first lever arm 18*a*, $l_1$ is the length of the first lever arm 18*a* between the tip 23*a* attached to the passive radiator 12 and fulcrum 19*a* (see FIG. 5), $l_2$ is the length of the first lever arm 18*a* between the fulcrum 19*a* and the center of gravity of the counter-balance mass 22*a* (see FIG. 5), $M_{counterbalance_2}$ is the mass of the counter-balance mass 22*b* of the second lever arm 18*b*, $l_3$ is the length of the second lever arm 18*b* between the tip 23*b* attached to the passive radiator 12 and fulcrum 19*b* (see FIG. 5), and $l_4$ is the length of the second lever arm 18*b* between the fulcrum 19*b* and the center of gravity of the counter-balance mass 22*b* (see FIG. 5).

To inertial and torque balance the system shown in FIG. 5, the mass of the passive radiator diaphragm ($M_{radiator}$) and masses of the counterbalances and lever arm ratios can be set as follows:

$$M_{radiator}=(l_2/l_1)^2*M_{counterbalance_1}+(l_4/l_3)^2*M_{counterbalance_2}, \text{AND} \quad \text{(equation 5)}$$

$$(l_2/l_1)^2*M_{counterbalance_1}+(l_4/l_3)^2*M_{counterbalance_2}=M_{ceff} \quad \text{(equation 6)}$$

Where $M_{ceff}$ is the effective compensation mass of the lever arm assemblies 18*a*, 18*b*.

Substituting equation 5 into equation 4, the following result is obtained:

$$M_T=M_{radiator}+M_{radiator}=2*M_{radiator}, \text{or}$$

$$M_{radiator}=½*M_T \quad \text{(equation 7)}$$

Note that equation 7 yields the same result as equation 3 in the single lever arm system. Thus, the moving mass of the passive radiator 12 can be set to ½ of the total effective moving mass ($M_T$) of the passive radiator assembly.

In equation 6, the effective compensation mass ($M_{ceff}$) of the lever arms 18*a*, 18*b* is introduced. Substituting this term into equation 5 yields:

$$M_{radiator}=M_{ceff}+M_{ceff}=2*M_{ceff} \quad \text{(equation 8)}$$

Substituting equations 6 and 8 into equation 4 yields the following:

$$M_T=2*M_{ceff}+M_{ceff}+M_{ceff}=4*M_{ceff}, \text{or} \quad \text{(equation 9)}$$

$$M_{ceff}=¼*M_T \quad \text{(equation 10)}$$

To solve for the compensation masses 22*a*, 22*b* and lever arm ratios for the lever arms 18*a*, 18*b*, substitute equation 10 into equation 6, which yields:

$$¼*M_T=(l_2/l_1)_2*M_{counterbalance_1}=(l_4/l_3)^2*M_{counterbalance_2} \quad \text{(equation 11)}$$

Note that selection of the counterbalance masses 22*a*, 22*b* is not unique since their magnitude is effected by selection of the lever arm ratios. Note, also, that the counter-balance masses and lever arm ratios can be different for each lever arm assembly, even if their resulting products are the same, although use of different lever arm segment lengths will result in different angular displacements which can cause the component of momentum in the direction of motion of the passive radiator diaphragm of each counterbalance mass to vary with respect to each other as a function of angular displacement. Note also that while equations 4-11 are for a two lever-arm system, these equations are readily extendible to any multi-arm system by simply adding terms like $(l_2/l_1)^2 * M_{counterbalance_1}$ to equation 4.

Using the above equations, a multi-lever arm system can be designed by first determining the total desired effective moving mass ($M_T$) of the passive radiator assembly, areas discussed previously. Once $M_T$ is determined, the mass of the passive radiator diaphragm can be set to be $\frac{1}{2} * M_T$ (equation 7), and then the counter-balance masses 22*a*, 22*b*, etc. and lever arm lengths $l_1$, $l_2$, $l_3$, $l_4$, etc. can be selected using equations 5 and 6 or equation 11.

In operation, the masses 22*a*, 22*b* move in an opposite direction as the passive radiator diaphragm 12 and, since they are selected to balance the mass of the passive radiator, they cancel much of the mechanical vibration experienced by the system 10 caused by movement of the passive radiator 12. In addition, use of multiple lever arms arranged symmetrically along the rear surface of the passive radiator helps to keep the passive radiator torque balanced. In other words, the two lever arms shown in FIGS. 4-6 serve to reduce rocking that might be experienced by the passive radiator at certain frequencies of operation.

Figure 7:
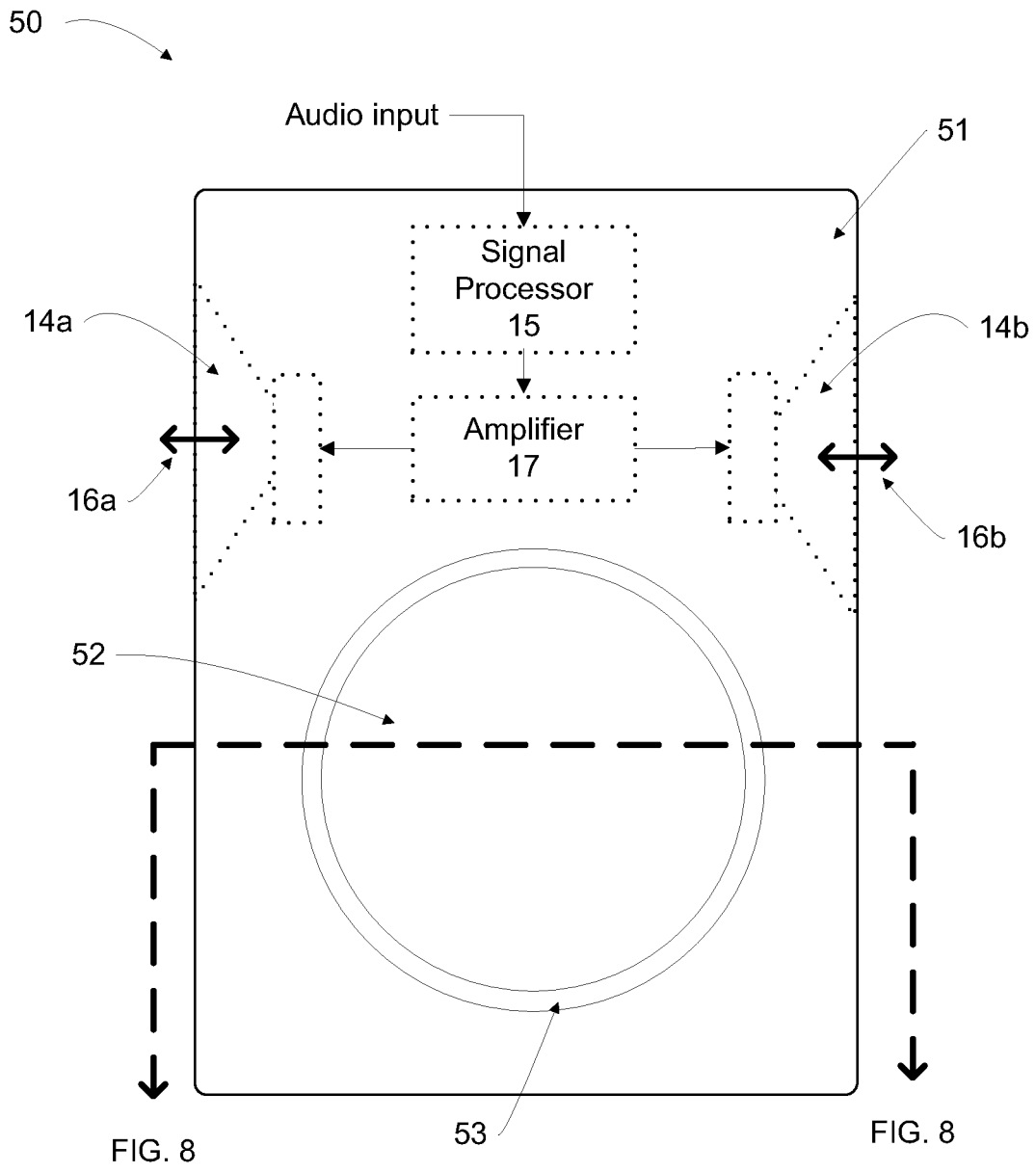
FIG. 7 is a front view of an enclosure with opposed drivers and a passive radiator.
Figure 8:
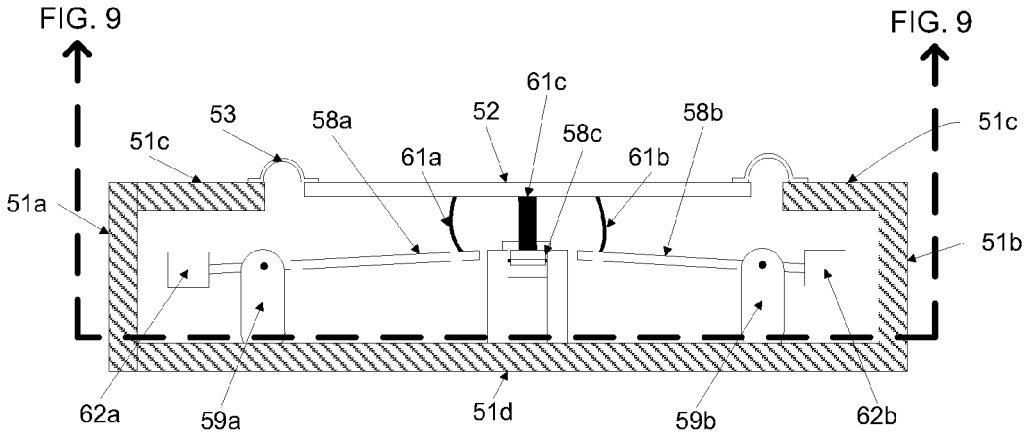
FIGS. 8-9 are cut-away views of the enclosure of FIG. 7.
Figure 9:
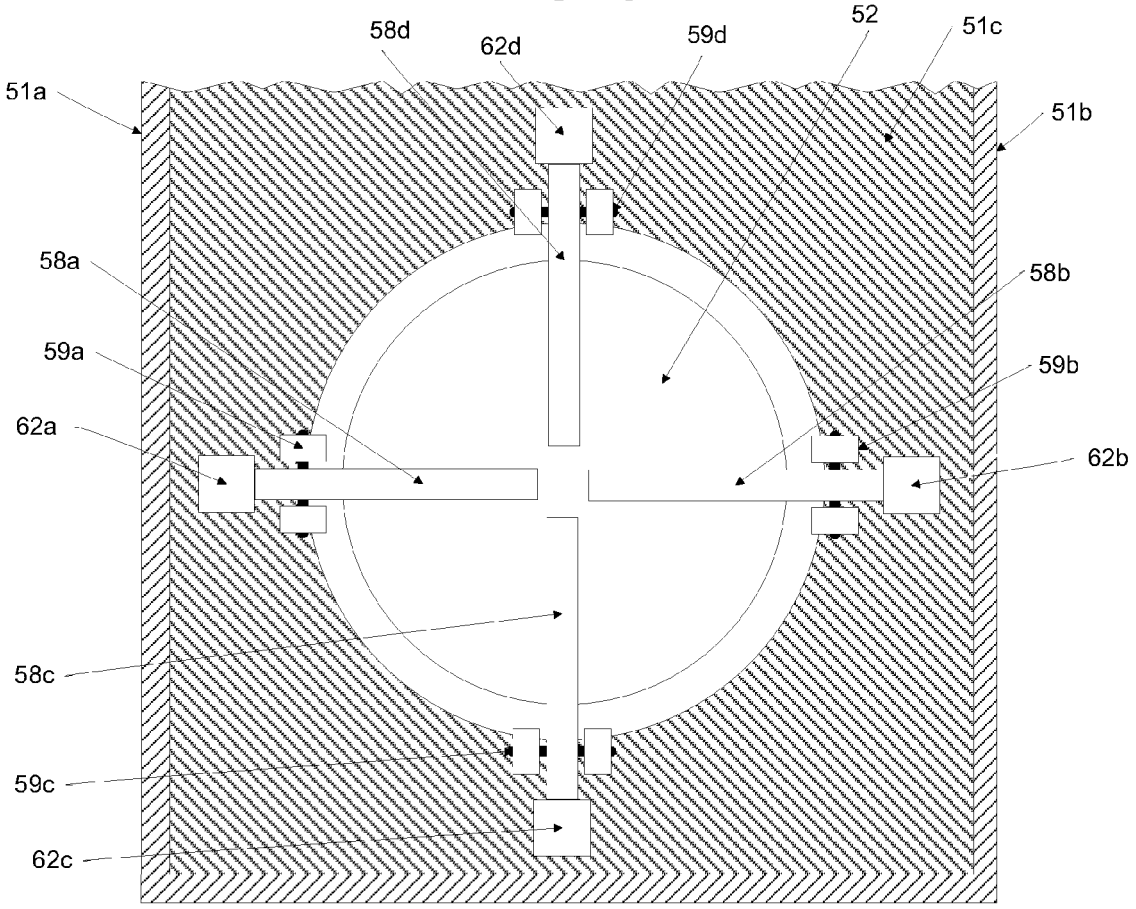

In some implementations, three or more lever arms may be used to mass balance and/or torque balance the passive radiator. Additionally, the lever arms may be attached within the enclosure at various attachment points to accommodate different packaging arrangements. For example, as shown in FIGS. 7-9, a system 50 uses four lever arms 58*a*-58*d* to mass and torque balance a circular-shaped passive radiator 52. In addition, the fulcrum 59*a*-59*d* of each lever arm are attached to a wall 51*d* of the enclosure opposite of the wall 51*c* in which the passive radiator 52 is mounted. (Note that in FIGS. 1-6 the fulcrums of the lever arms are mounted on the same enclosure wall as the passive radiator). The system 50 shown in FIGS. 7-9 include similar elements as described in previous embodiments including a signal processor 15, amplifier 17 and a pair of transducers 14*a*, 14*b* that are configured such that their acoustic energy generally adds while their mechanical vibrations generally cancel.

Figure 10:
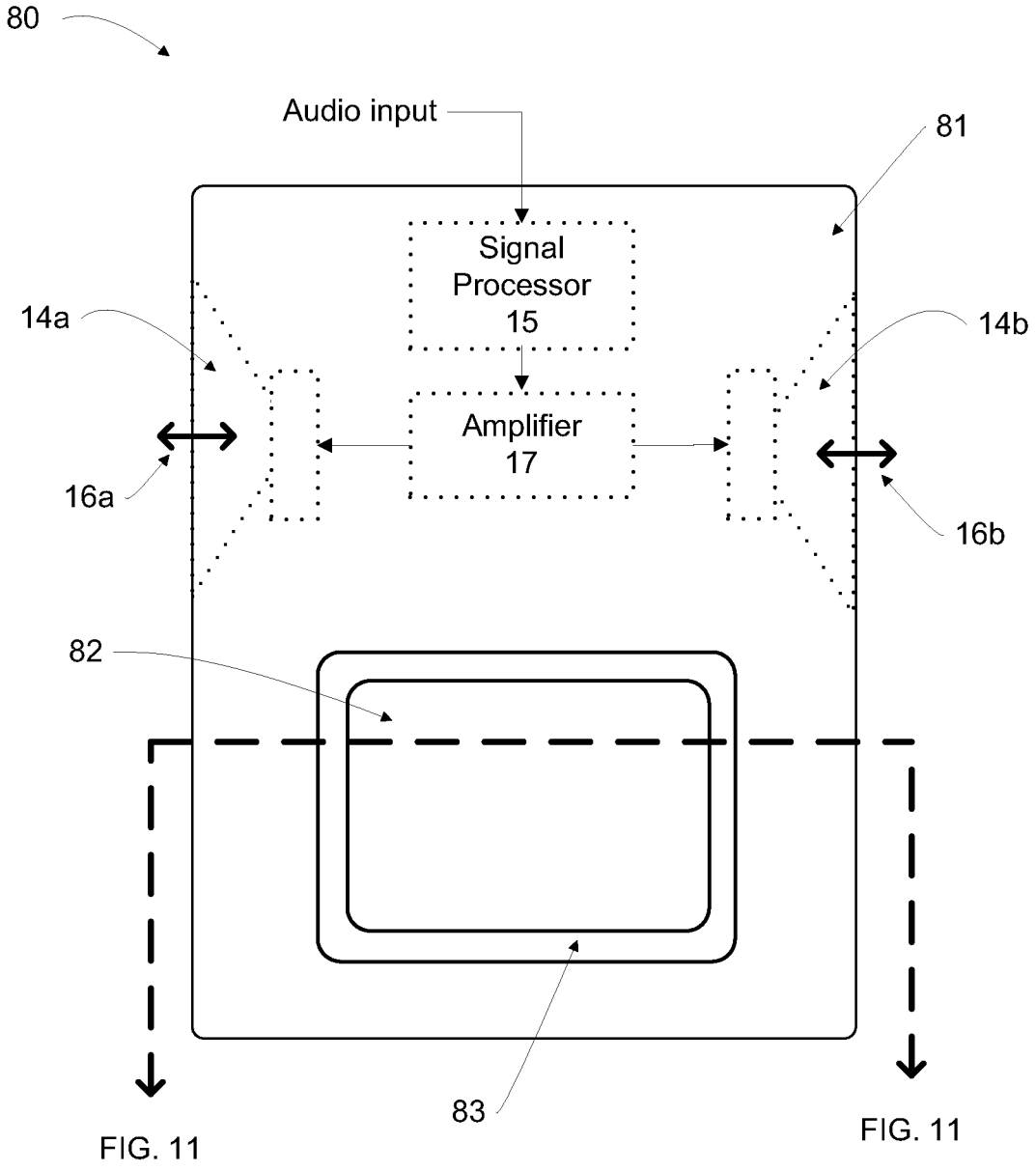
FIG. 10 is a front view of an enclosure with opposed drivers and a passive radiator.
Figure 11:
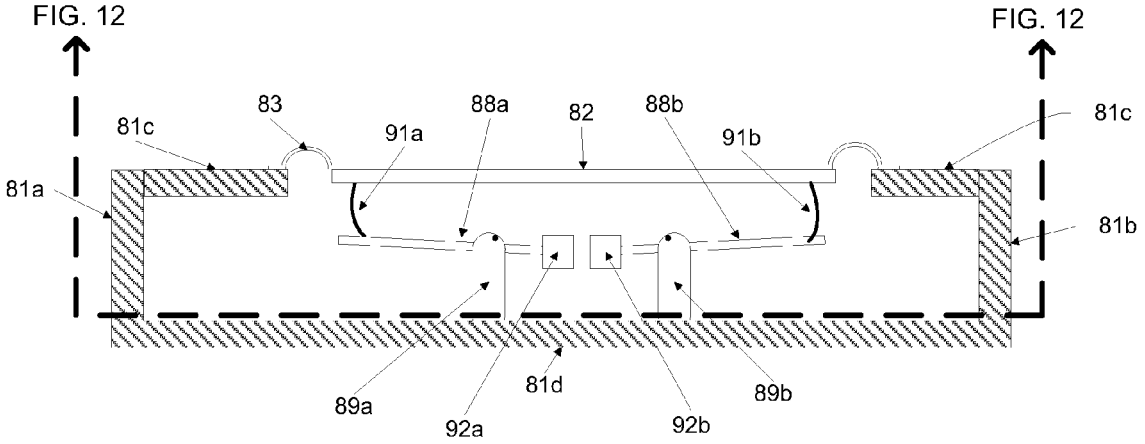
FIGS. 11-12 are cut-away views of the enclosure of FIG. 10.
Figure 12:
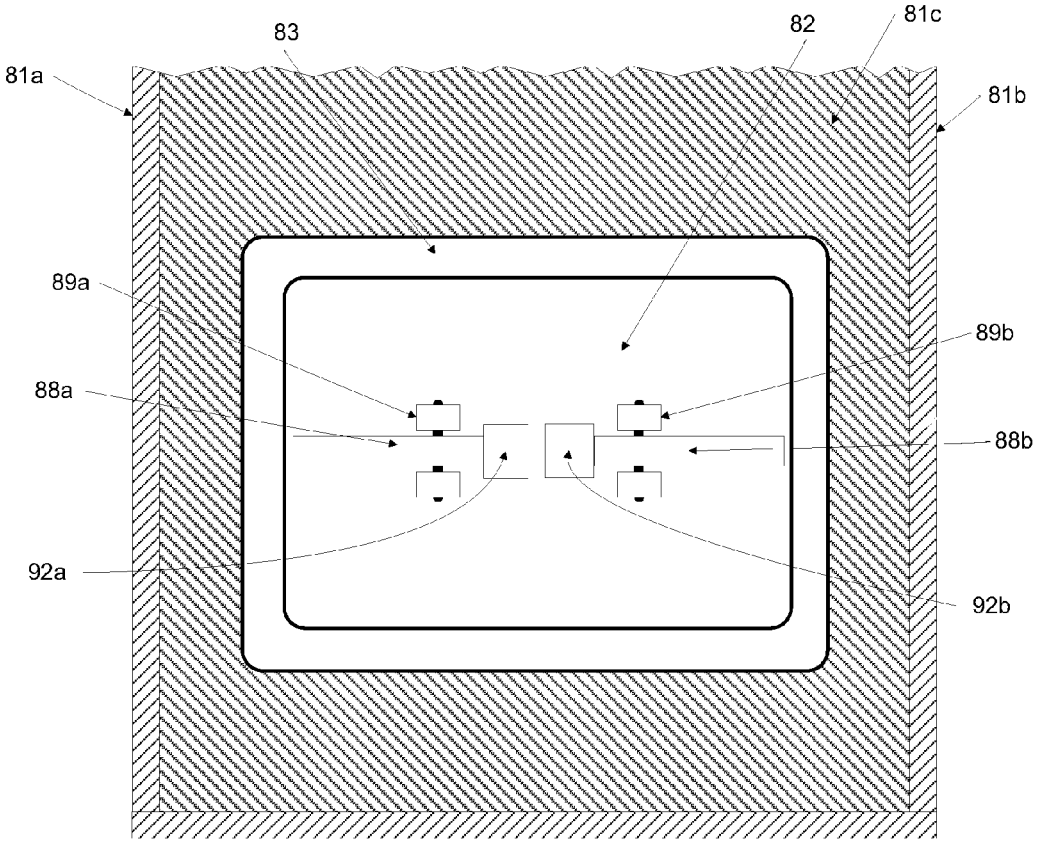

The lever arms may also be mounted such that they are mounted in-board of the perimeter of passive radiator. For example, as shown in FIGS. 10-12, a system 80 includes a pair of lever arms 88*a*, 88*b* mounted within the perimeter of a passive radiator 82. More specifically, lever arms 88*a*, 88*b* are mounted to the inner surface of the rear wall 81*d* of the enclosure 81. As in other embodiments, each lever arm includes a coupling (91*a*, 91*b*), fulcrum (89*a*, 89*b*), and counter-balance mass (92*a*, 92*b*). The counter-balance masses 92*a*, 92*b* are selected to cancel inertial forces generated by the moving passive radiator 82. The enclosure 81 serves as the mechanical ground, and since the enclosure 81 is in direct contact with the surface on which system 80 sits, few mechanical vibrations are transmitted from system 80 to its supporting surface. The arrangement of the lever arms in this embodiment also provides some resistance to rocking of the passive radiator 82. In other implementations, additional lever arms may be used to provide further resistance to rocking (including fully-torque balancing the passive radiator like what is shown in FIGS. 7-9) and also cancel inertial forces generated by the moving passive radiator.

There has been described novel apparatus and techniques for reducing vibration of a driver enclosure through counteracting force and rocking of a passive radiator. It is evident that those skilled in the art may now make numerous uses and modifications of and departures these specific apparatus and techniques herein disclosed without departing from the inventive concepts. Consequently, the invention is to be construed as embracing each and every novel feature and each and every novel combination of features present at in or possessed by the apparatus and techniques herein disclosed and limited solely by the spirit and scope of the appended claims.

What is claimed is:

1. An audio system comprising:

an enclosure enclosing a volume of air;

a first transducer for producing acoustic energy from an electrical signal, the first transducer mounted to the enclosure and in fluid communication with the volume of air such that the transducer creates pressure fluctuations in the volume of air;

a passive radiator mounted to the enclosure and in fluid communication with the volume of air end in fluid communication with air outside of the enclosure, wherein the passive radiator comprises a diaphragm that is moved in and out relative to the enclosure solely by a pressure differential across the diaphragm;

a fulcrum fixed to a mechanical ground; and a lever arm mechanically coupled to the fulcrum and mechanically coupled to the diaphragm on a first side of the fulcrum, the lever arm having a mass coupled to it on a second side of the fulcrum, wherein the lever arm and its mass are configured to move with the diaphragm such that movement of the lever arm and its mass reduce a level of vibration transmitted to the mechanical ground caused by movement of the diaphragm when compared with the level of vibration transmitted to the mechanical ground by movement of the diaphragm without the operation of the lever arm and its mass, wherein such movement of the lever arm is caused solely by movement of the diaphragm.

2. The audio system of claim 1, wherein the enclosure comprises the mechanical ground.

3. The audio system of claim 1, further comprising:

a second fulcrum fixed to the mechanical ground;

a second lever arm mechanically coupled to the second fulcrum and mechanically coupled to the diaphragm on a first side of the second fulcrum, the second lever arm having a second mass coupled to it on a second side of the second fulcrum, wherein both the first and second lever arms and their masses are configured to move along with the diaphragm such that movement of the lever arms and their masses reduce a level of vibration transmitted to the mechanical ground caused by movement of the diaphragm when compared with the level of vibration transmitted to the mechanical ground by movement of the diaphragm without the operation of the lever arms and their masses, wherein such movement of the second lever arm is caused solely by movement of the diaphragm.

4. The audio system of claim 3, wherein the first and second lever arms also provide a greater resistance to rocking by the diaphragm when compared with the diaphragm without operation of the lever arms and their masses.

5. The audio system of claim 4, wherein the enclosure comprises the mechanical ground.

6. The audio system of claim 1, wherein the enclosure comprises a first wall having an inner surface and an outer surface, and the passive radiator is mounted within an opening in the first wall and the fulcrum is fixed to the inner surface of the first wall.

7. The audio system of claim 1, wherein the enclosure comprises:

a first wall having an inner surface and an outer surface; and a second wall having an inner surface and an outer surface, the second wall parallel to the first wall, and wherein the passive radiator is mounted within an opening in the first wall and the fulcrum is attached to the inner surface of the second wall.

8. The audio system of claim 1 further comprising:

a second transducer for producing acoustic energy from the same electrical signal as the first transducer, the second transducer mounted to the enclosure and in fluid communication with the volume of air, wherein the first and second transducers are mounted on the enclosure such that the acoustic energy they output into the volume of air adds while the mechanical vibrations transmitted by the transducers into the enclosure subtract.

9. The audio system of claim 1, further comprising:

a coupling that attaches the lever arm to the diaphragm.

10. The audio system of claim 9, wherein the coupling is a compliant coupling.

11. An audio system comprising:

an enclosure enclosing a volume of air;

a first transducer for producing acoustic energy from an electrical signal, the first transducer mounted to the enclosure and in fluid communication with the volume of air such that the first transducer creates pressure fluctuations in the volume of air;

a passive radiator mounted to the enclosure and in fluid communication with the volume of air and in fluid communication with air outside of the enclosure, wherein the passive radiator comprises a diaphragm that is moved in and out relative to the enclosure solely by a pressure differential across the diaphragm; and a plurality of lever arms coupled to the diaphragm at a first end of each lever arm, wherein each lever arm is pivotally attached to a fulcrum and each of the fulcrums are attached to a mechanical ground, wherein each lever arm includes a mass on the side of the fulcrum that is opposite the side on which the lever arm is coupled to the diaphragm, wherein the lever arms are configured to move the masses out of phase with movement of the diaphragm, and wherein such movement of the lever arms is caused solely by movement of the diaphragm.

12. The audio system of claim 11, wherein the plurality of lever arms are arranged to torque balance the passive radiator.

13. The audio system of claim 11, wherein the plurality of lever arms are coupled symmetrically around a surface of the diaphragm.

14. The audio system of claim 11, wherein the plurality of lever arms also provide a greater resistance to rocking by the diaphragm when compared with the diaphragm without operation of the lever arms and their masses.

15. The audio system of claim 11, wherein movement of the plurality of lever arms reduce a level of vibration transmitted to the mechanical ground caused by movement of the diaphragm when compared with the level of vibration transmitted to the mechanical ground by movement of the diaphragm without the operation of the lever arms and their masses.

16. The audio system of claim 11, wherein the enclosure comprises the mechanical ground.

17. The audio system of claim 11, wherein the enclosure comprises a first wall having an inner surface and an outer surface, and the passive radiator is mounted within an opening in the first wall and the fulcrum of each of the plurality of lever arms is fixed to the inner surface of the first wall.

18. The audio system of claim 11, wherein the enclosure comprises:

a first wall having an inner surface and an outer surface; and a second wall having an inner surface and an outer surface, the second wall parallel to the first wall, and wherein the passive radiator is mounted within an opening in the first wall and the fulcrum of each of the plurality of lever arms is attached to the inner surface of the second wall.

19. The audio system of claim 11, wherein the enclosure comprises a first wall having an inner surface and an outer surface, and the passive radiator is mounted within an opening in the first wall and the fulcrum of at least one of the plurality of lever arms is fixed to the inner surface of the first wall.

20. The audio system of claim 11, wherein the enclosure comprises:

a first wall having an inner surface and an outer surface; and a second wall having an inner surface and an outer surface, the second wall parallel to the first wall, and wherein the passive radiator is mounted within an opening in the first wall and the fulcrum of at least one of the lever arms is attached to the inner surface of the second wall.

21. The audio system of claim 11, further comprising:

a second transducer for producing acoustic energy from the same electrical signal as the first transducer, the second transducer mounted to the enclosure and in fluid communication with the volume of air, wherein the first and second transducers are mounted on the enclosure such that the acoustic energy they output into the volume of air adds while the mechanical vibrations transmitted by the transducers into the enclosure subtract.

22. The audio system of claim 11, further comprising a plurality of couplings, each coupling attaching a lever arm to the diaphragm.

23. A passive radiator assembly configured to mount in an acoustic enclosure that encloses a volume of air, where there is a transducer for producing acoustic energy from an electrical signal, the transducer mounted to the enclosure and in fluid communication with the volume of air such that the transducer creates pressure fluctuations in the volume of air, the passive radiator assembly comprising:

a diaphragm mounted to the enclosure and in fluid communication with the volume of air and in fluid communication with air outside of the enclosure, wherein the diaphragm is moved in and out relative to the enclosure solely by a pressure differential across the diaphragm;

a flexible surround coupled to the diaphragm, wherein the surround permits movement of the diaphragm in response to pressure fluctuations in the enclosure; and a lever arm assembly comprising:

a fulcrum configured to be fixed to a mechanical ground; and a lever arm mechanically coupled to the fulcrum, and mechanically coupled to the diaphragm on a first side of the fulcrum, the lever arm having a mass coupled to it on a second side of the fulcrum, wherein the lever arm is configured to move the mass out of phase with movement of the diaphragm wherein such movement of the lever arm is caused solely by movement of the diaphragm.

24. The passive radiator assembly of claim 23 further comprising:

a second lever arm assembly comprising:

a second fulcrum fixed to the mechanical ground; and a second lever arm mechanically coupled to the diaphragm on a first side of the second fulcrum, the second lever arm having a second mass coupled to it on a second side of the second fulcrum, wherein the second lever arm is configured to move the second mass out of phase with movement of the diaphragm, wherein such movement of the second lever arm is caused solely movement of the diaphragm.

25. The passive radiator assembly of claim 24, wherein the first and second lever arms also provide a greater resistance to rocking by the diaphragm when compared with the diaphragm without operation of the first and second lever arms and their masses.

26. The passive radiator assembly of claim 23 wherein the mechanical ground is the enclosure.

27. The passive radiator assembly of claim 23 further comprising a plurality of lever arm assemblies, each lever arm assembly comprising (i) a fulcrum fixed to a mechanical ground; and (ii) a lever arm mechanically coupled to the fulcrum and mechanically coupled to the diaphragm on a first side of the fulcrum, the lever arm having a mass coupled to it on a second side of the fulcrum, wherein the lever arm is configured to move the mass out of phase with movement of the diaphragm, wherein such movement of the lever arm is caused solely by movement of the diaphragm.

28. The passive radiator assembly of claim 27 wherein the plurality of lever arm assemblies are arranged to torque balance the passive radiator.

* * * * *